US010926842B2

(12) United States Patent
Gourmelon et al.

(10) Patent No.: US 10,926,842 B2
(45) Date of Patent: Feb. 23, 2021

(54) LINE INTENDED TO BE IMMERSED IN AN AQUATIC ENVIRONMENT

(71) Applicant: THALES, Courbevoie (FR)

(72) Inventors: Denis Gourmelon, Brest (FR); Michaël Jourdan, Brest (FR); Dominique Brechet, Brest (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/470,963

(22) PCT Filed: Dec. 19, 2017

(86) PCT No.: PCT/EP2017/083620

§ 371 (c)(1),
(2) Date: Jun. 18, 2019

(87) PCT Pub. No.: WO2018/114997

PCT Pub. Date: Jun. 28, 2018

(65) Prior Publication Data

US 2019/0315441 A1 Oct. 17, 2019

(30) Foreign Application Priority Data

Dec. 20, 2016 (FR) ..... 16 01811

(51) Int. Cl.
*B63B 22/18* (2006.01)
*G10K 11/00* (2006.01)
(Continued)

(52) U.S. Cl.
CPC ..... *B63B 22/18* (2013.01); *B63C 11/48* (2013.01); *G10K 11/006* (2013.01); *B63B 2022/006* (2013.01); *B63B 2211/02* (2013.01)

(58) Field of Classification Search
CPC ..... B63B 22/18; B63B 2022/006; B63B 2211/02; B63B 22/00; B63C 11/48; G10K 11/006; G10K 11/00
See application file for complete search history.

(56) References Cited

U.S. PATENT DOCUMENTS 3,027,539 A 3/1962 Stillman, Jr.
3,329,015 A 7/1967 Bakke et al.
(Continued)

FOREIGN PATENT DOCUMENTS

CA 2 189 805 A1 5/1998
DE 42 26 614 A1 2/1994
WO 03/062044 A1 7/2003

*Primary Examiner* — Anthony D Wiest
(74) *Attorney, Agent, or Firm* — BakerHostetler

(57) ABSTRACT

A line intended to be submerged in an aquatic environment. The line includes a mooring configured to be placed on the bottom of the aquatic environment and for immobilizing the line relative to the bottom, a buoy configured to float on the surface of the aquatic environment, an object extending along a vertical axis, having a center of balance of hydrodynamic forces when the object is subjected to a horizontal water current and called the hydrodynamic center, and having a center of gravity vertically remote from the hydrodynamic center, a frame connected to the object by a pivoting link with a substantially horizontal axis passing through the hydrodynamic center, at least one fin extending vertically, whereby the object can be oriented relative to a horizontal water current, a first section of line connecting the mooring to the frame, a second section of line connecting the frame to the buoy.

8 Claims, 3 Drawing Sheets

(51) Int. Cl.
*B63B 22/00* (2006.01)
*B63C 11/48* (2006.01)

(56) References Cited

U.S. PATENT DOCUMENTS

| | | | | | |
|---|---|---|---|---|---|
| 3,455,159 | A | | 7/1969 | Gies | |
| 3,590,635 | A | * | 7/1971 | Duing | G01C 13/00<br>73/170.29 |
| 3,660,807 | A | | 5/1972 | Depew et al. | |
| 3,935,592 | A | * | 1/1976 | Dahlen | G01D 1/02<br>360/6 |
| 5,364,297 | A | * | 11/1994 | Rohardt | B63B 22/18<br>114/230.2 |

* cited by examiner

LINE INTENDED TO BE IMMERSED IN AN AQUATIC ENVIRONMENT

CROSS-REFERENCE TO RELATED APPLICATIONS

This application is a National Stage of International patent application PCT/EP2017/083620, filed on Dec. 19, 2017, which claims priority to foreign French patent application No. FR 16 01811, filed on Dec. 20, 2016, the disclosures of which are incorporated by reference in their entirety.

FIELD OF THE INVENTION

The invention relates to a line intended to be submerged in an aquatic environment. A line of this kind can be employed to hold an object at a certain depth relative to the surface. An object of this kind can for example be a passive or active sonar antenna.

BACKGROUND

Sonar antennas can be towed behind a surface vessel. It can also be useful to have an antenna which remains fixed in position. To that end, it is known to use air-dropped sonar buoys. Once the buoy has reached the surface of the water after the drop, it deploys a sonar antenna at a given depth. The buoy is connected to the antenna by an electric/load-bearing cable. The antenna receives sound information from the aquatic environment. The antenna sends this information to the buoy via the electric/load-bearing cable. In turn, the buoy sends, by radio, the information received from the sonar antenna, for example to the aircraft that dropped the buoys.

This type of buoy has a drawback. The sonar antenna is connected only to the buoy, and in the presence of marine currents the assembly formed by the buoy and the antenna drifts at the mercy of the current. Moreover, marine currents can be different at the surface and at the depth at which the antenna is submerged. The electric/load-bearing cable is then inclined, causing the antenna to be inclined as well. The inclination of the antenna with respect to the vertical can compromise its mission. Indeed, the inclination of the antenna causes the receiving sound lobes and, in the case of an active antenna, the transmitting sound lobes to be inclined. The inclination of the sound lobes impairs the performance of the sonar since they might experience interference with the bottom or the surface.

One attempt to better keep the sonar antenna in position has been to anchor the buoy and its antenna to the bottom. Anchoring makes the antenna even more susceptible to the current.

SUMMARY OF THE INVENTION

The invention aims to remedy some or all of the above-mentioned problems by proposing a line that is submerged in the aquatic environment, is anchored at one of its ends and has a buoy at the other end, with an object being attached between the anchor point and the buoy. The line comprises means for keeping the object vertical, even in the presence of a current in the aquatic environment.

More specifically, the invention relates to a line intended to be submerged in an aquatic environment, characterized in that it comprises:

- a mooring configured to be placed on the bottom of the aquatic environment and for immobilizing the line relative to the bottom,
- a buoy configured to float on the surface of the aquatic environment,
- an object extending along a vertical axis, having a center of balance of hydrodynamic forces when the object is subjected to a horizontal water current and called the hydrodynamic center, and having a center of gravity vertically remote from the hydrodynamic center,
- a frame connected to the object by a pivoting link with a substantially horizontal axis passing through the hydrodynamic center,
- at least one fin extending vertically, whereby the object can be oriented relative to a horizontal water current,
- a first section of line connecting the mooring to the frame,
- a second section of line connecting the frame to the buoy.

Advantageously, the at least one fin is secured to the frame.

The object comprises, for example, an upper part that is configured to receive and/or transmit information to the aquatic environment and a lower part that comprises utilities. Advantageously, the at least one fin faces the lower part without facing the upper part.

The pivoting link advantageously comprises two coaxial bearings connecting the object to the frame, the two bearings being arranged on either side of the hydrodynamic center.

The line advantageously comprises a swivel arranged between the mooring and the frame.

The swivel may be arranged between the first section of line and the frame.

The object may comprise an acoustic transmitter and an acoustic receiver.

The second section of line advantageously comprises a cable that is configured to send information from the object to the buoy, and the buoy comprises a transmitter that is configured to send, through the air, the information received from the object.

BRIEF DESCRIPTION OF THE DRAWINGS

The invention will be better understood and further advantages will become apparent upon reading the detailed description of one embodiment provided by way of example, which description is illustrated by the attached drawing, in which.

For the sake of clarity, the same elements will bear the same references in the various figures.

DETAILED DESCRIPTION

Figure 1:
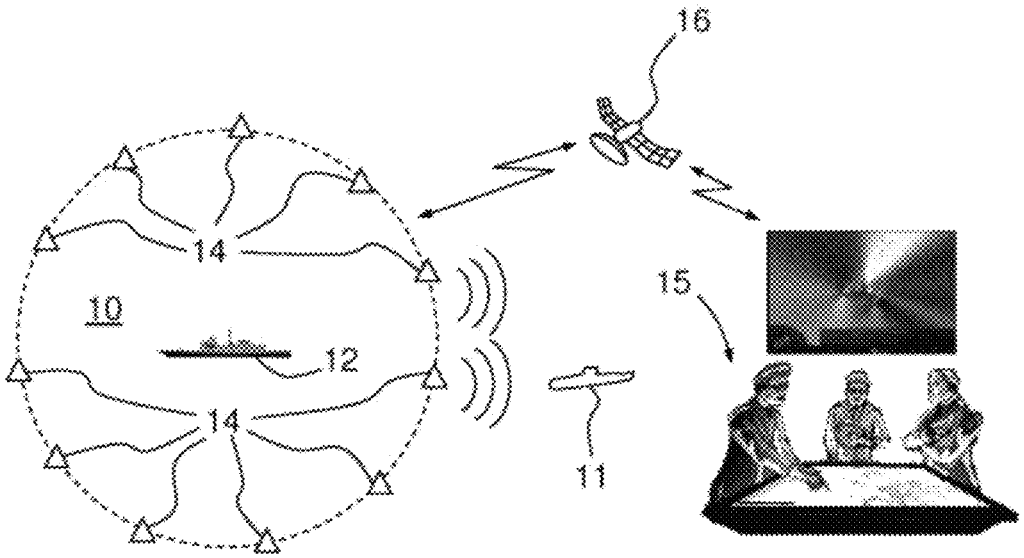
FIG. 1 shows an exemplary use of a submerged line according to the invention.

FIG. 1 shows, schematically, an aquatic environment 10 in which one is trying to detect the presence of a submarine 11 that might pose a threat to a surface vessel 12. To that end, multiple sonar antennas 14 are arranged in the area where the surface vessel 12 is sailing, each one having a fixed position with respect to the bottom. Each antenna 14 may be active and comprises an acoustic transmitter and receiver, with the receiver receiving an echo of a sound wave sent by the transmitter. The sought-after echo is of course returned by the hull of the submarine 11. Alternatively, the antenna may be passive. In that case, it comprises no sound transmitter and merely detects sound waves in order to identify those coming from the sought-after submarine 11, or more generally any threat approaching the zone of interest containing the surface vessel 12. More generally, the sonar system comprising the various antennas 14 can operate in a bistatic mode in which each antenna is configured to receive an echo of a sound wave that it transmits. The sonar system may operate in a multi-static mode in which each antenna is configured to receive an echo of a sound wave originating from another antenna of the system.

Each sonar antenna 14 is arranged on a line that is submerged between an anchoring point and a floating buoy. The buoy may receive information from the antenna and send this information to a ground station 15, for example via the intermediary of a satellite 16. The buoy may also send information received from the antenna to other stations allowing processing of the information, for example stations on board the surface vessel 12 or of an airplane flying over the zone where the antennas 14 are submerged. For transmission to the surface vessel 12 or an airplane, it is possible to transmit directly without passing via the satellite 16, for example using VHF radio transmission.

In FIG. 1, the various antennas 14 are arranged in a circle around the surface vessel 12. The invention is not limited to this arrangement. It is for example possible to arrange the antennas in a straight line. More generally, the invention may be implemented for a single antenna 14, and even for any object which one wishes to arrange submerged at a given position and depth. Another mission of the object may be to measure the velocity of a marine current at a predefined depth. The object is then equipped with a water flow velocity sensor.

Figure 2:
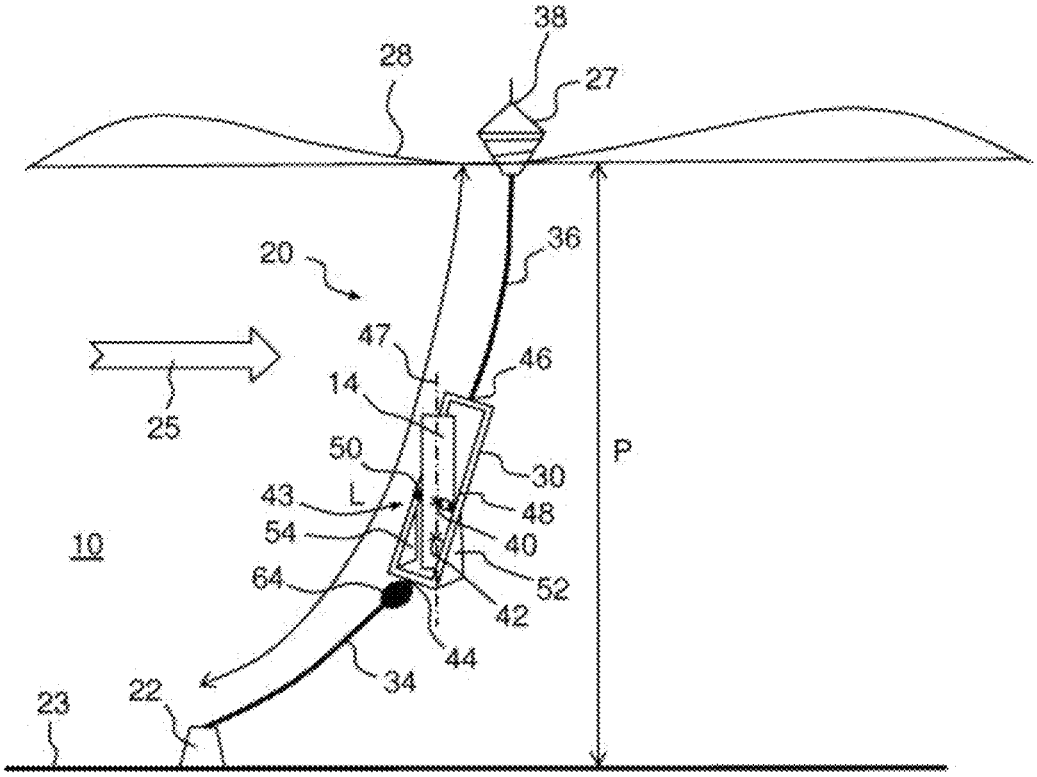
FIG. 2 shows a submerged line according to the invention.

FIG. 2 shows, in greater detail, the submerged line which in this case bears the reference 20. The line 20 comprises a mooring 22 (also known as a "sinker") that is configured to rest on the bottom 23 of the aquatic environment 10 so as to immobilize the line 20 with respect to the bottom 23. A mooring is to be understood as any device that can remain immobile on the bottom 23. The mooring 22 may be an inert mass, for example made of concrete. This inert mass is heavy enough to immobilize the line 20. Any other means that serves to immobilize the line 20 with respect to the bottom 23 may be implemented. The mooring 22 may be an anchor that can catch on the bottom 23. It is possible to combine various immobilizing means, inert mass and anchor. The mooring 22 is dimensioned such that the mooring 22 remains immobile on the bottom 23 when acted upon by a given current 25 that tends to exert a force on the line 20. At sea, it is possible to experience tidal currents which, in particular areas, can exceed 5 kn during spring tides. The mooring 22 is defined in dependence on the maximum drag force experienced by the line 20 when acted upon by the maximum current existing in the location where the line 20 is deployed.

The line 20 comprises a buoy 27, configured to float to the surface 28 of the aquatic environment 10, and a frame 30 that serves to maintain the vertical orientation of an object which, in the example shown, is the sonar antenna 14. In order to keep the buoy 27, the frame 30 and the mooring 22 secured to one another, the line 20 comprises a line section 34 connecting the mooring 22 to the frame 30 and a line section 36 connecting the frame 30 to the buoy 27. The two sections 34 and 36 may be cables or ropes.

The sonar antenna or more generally the object 14 may be autonomous. The object 14 may be provided with a detector and a memory which records, at predefined intervals, data collected by the detector. Periodically, the line 20 may be raised to recover the recorded data.

Alternatively, the object 14 may share in real-time the data that it collects, with a station external to the line 20. To that end, the line section 36 comprises a cable that is configured to send information from the object 14, and for example the acoustic receiver thereof, to the buoy 27. The line section 36 may be electric and load-bearing and comprise for example electrical conductors that form a core surrounded by load-bearing armor. Alternatively, the line section 36 may consist of a load-bearing cable around which is coiled an electric cable that sends information between the object 14 and the buoy 27. The buoy 27 comprises a transmitter 38 that is configured to send, through the air, the information received from the object 14. The transmitter may be of any kind, for example a radio or optical transmitter.

The length L of the line 20 between the mooring 22 and the buoy 27 is defined in dependence on the depth P of the aquatic environment 10 where the line is intended to be deployed. The depth P is the distance between the surface 28 and the bottom 23. The aquatic environment 10 may experience tides, and the length L of the line 20 must take into account the tidal range. Advantageously, the buoy 27 always floats at the surface 28 in order to continuously send its information by means of its transmitter 38. The length L of the line 20 is then greater than the depth P at the highest tide. Alternatively, it is possible to reduce the length L such that the buoy 27 can float only intermittently, for example at low tide. This reduced length may be useful in the case of an object 14 provided with a recorder. Recovery of the data then takes place when the buoy 27 is floating. The length of each of the two line sections 34 and 36 may also be adjusted to account for the bathycelerity profiles of the zone in which the line 20 is submerged. When the length L of the line 20 is greater than the depth P, the object 14 and the buoy 27 will move around the mooring 22 at the mercy of the current 25. This creates, in particular, an oscillation around the position of the mooring 22 when the line 20 is submerged in an environment where the tides produce alternating currents. Thus, the line sections 34 and 36 are inclined with respect to the vertical. This inclination presents difficulties for maintaining the orientation of the object 14 with respect to the vertical direction. Holding the object 14 is useful, as stated above, for a sonar listening mission. This holding is also useful for a mission for measuring marine currents. These difficulties are solved by the invention.

The object 14 has external shapes that serve to define a center of balance of hydrodynamic forces when the object 14 is subjected to a horizontal water current 25. This center is more simply referred to as the hydrodynamic center 40. In a first approach, the position of hydrodynamic center 40 does not depend on the intensity of the current, but solely on the forms of the object 14. When the object 14 is held by its hydrodynamic center 40, the hydrodynamic forces exerted by a horizontal current above the hydrodynamic center 40 balance out the same forces exerted below the hydrodynamic center 40. For example, when the object 14 is a vertically oriented cylinder, the hydrodynamic center 40 is located at half the height of the object 14. The position of the hydrodynamic center 40 may depend on the surface state of the object 14. It is possible to determine its position by trials in a reference aquatic environment with a current of predetermined intensity.

The object 14 also has a center of gravity 42. The object 14 is configured such that its center of gravity 42 is at a vertical distance from its hydrodynamic center 40.

At least one pivoting link 43 of essentially horizontal axis 45 passing through the hydrodynamic center 40 connects the frame 30 and the object 14. The distance between the axis of the pivoting link 43, passing through the hydrodynamic center 40, and the center of gravity 42 naturally encourages a stable position of the object 14, which holds itself vertically whether in the absence or presence of a current 25, the center of gravity 42 being located below the hydrodynamic center 40.

In the example shown, the frame 30 surrounds the object 14. Line section 34 is attached to the frame 30 at an attachment point 44 and line section 36 is attached to the frame 30 at an attachment point 46. In the absence of a current, when the two line sections 34 and 36 are aligned vertically, the hydrodynamic center 40, the center of gravity 42 and the two attachment points 44 and 46 are also aligned along a vertical axis 47 of the object 14. Thus, the various vertical forces applied to the frame 30, that is to say the forces from the two line sections 34 and 36 and the force due to the weight of the object 14, are all aligned. This alignment serves to keep the axis of the pivoting link horizontal. Advantageously, and as in the example shown, the pivoting link 43 is established by means of two coaxial bearings 48 and 50 which allow the object 14 to rotate, about the axis 45, with respect to the frame 30. The two bearings 48 and 50 are positioned on either side of the hydrodynamic center 40. The presence of these two bearings 48 and 50 avoids the object 14 being supported in a cantilever manner with respect to the frame 30. This arrangement of the hydrodynamic center 40, the center of gravity 42 and the pivoting link 43 serves to keep the object 14 vertical. In other words, the axis 47 passing through the hydrodynamic center 40 and the center of gravity 42 remains vertical. It is still possible for the object 14 to rotate on its axis 47. The line sections 34 and 36 may be very long, and twisting of these sections is possible. It is possible to know this rotation by fitting the object 14 with a compass. However, the axis 45 of the pivoting link 43 may align itself with the current 25. With this orientation, if the frame 30 is inclined with respect to the vertical, the axis 45 of the pivoting link 43 is no longer horizontal and the axis 47 of the object 14 passing through its hydrodynamic center 40 and its center of gravity 42 no longer remains vertical. In order to stabilize the object 14 in rotation about its axis 47, it is possible to fit the object 14 with at least one vertical fin. In the presence of a current 25, this fin points in the direction of the current 25 and serves to keep the axis 45 of the pivoting link 43 perpendicular to the current.

However, the presence of one or more fins attached to the object 14 has a drawback by changing the shape of the object 14. Fins of this kind can for example hamper the propagation of acoustic waves and it is advantageous for the object 14 to remain rotationally symmetric about its vertical axis 47. The presence of fins attached to the object 14 has another drawback linked to the fact that these fins change the hydrodynamic behavior of the object 14. The fins attached to the object 14 present a risk of instability in the position of the hydrodynamic center 40. In the event of turbulence in the current, the presence of fins on the object 14 could weaken the effect of keeping it in the vertical position. In order to ensure the stability of the orientation of the object 14, without adding any extra physical features, at least one fin extending vertically is attached to the frame 30. In the presence of a current 25, the frame 30 aligns itself with the axis of the current 25 and the object 14 follows the orientation of the frame 30. In the example shown, the frame 30 is equipped with two fins 52 and 54, each located close to one of the bearings 48 and 50.

Figure 3:
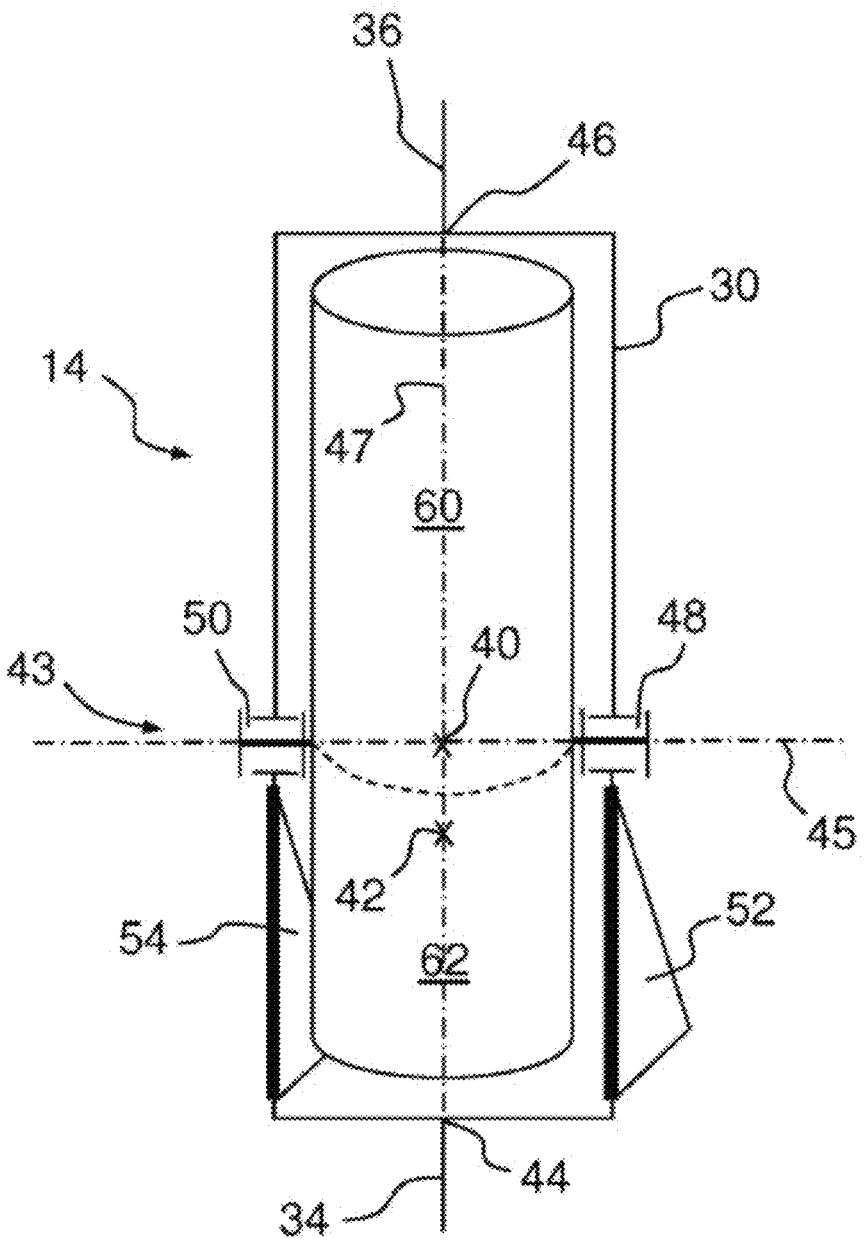
FIG. 3 shows, in greater detail, the line from FIG. 2 at an object attached to the line.

FIG. 3 shows the object 14 and the frame 30. The object 14 comprises an upper part 60, referred to as the active part, comprising sound transmitters and/or receivers, or other types of sensor, and a lower part 62 comprising utilities such as a battery and electronic modules which in particular format information received from the sensors or receivers, or in the direction of the transmitters. The presence of a battery in the lower part 62 tends to lower the position of the center of gravity 42. The active part 60 receives and/or transmits information to the aquatic environment 10, such as sound waves for example, while the lower part 62 communicates only internally with the object 14 or to the electric/load-bearing cable of section 36. Advantageously, the fins 52 and 54 face the lower part 62 without facing the upper part 60. Thus, the fins do not hamper the propagation of information in the aquatic environment 10. The fins 52 and 54 are located in the lower part of the frame 30, below the bearings 48 and 50.

The orientation of the object 14 depending on the current 25 by virtue of the fins 52 and 54 may be braked by line section 34. Indeed, this orientation requires twisting of line section 34. Small twists are often possible. However, reversal of the current 25 is possible, such that it is necessary to be able to twist through 180°, or even several full turns. In order to facilitate the orientation of the object, the line 20 comprises a swivel 64 arranged between the mooring 22 and the frame 30. The swivel 64 provides the frame 30 with the freedom to rotate with respect to the mooring 22, about a longitudinal axis of line section 34. The shackle 64 is advantageously arranged between line section 34 and the frame 30, and constitutes attachment point 44 so as to avoid any twisting of line section 34. It is also possible to arrange another swivel located between the frame 30 and the buoy 27, for example to allow the buoy 27 to turn freely about line section 36. In practice, this other swivel may be installed in the absence of an electric/load-bearing cable connecting the buoy 27 to the object 14. To that end, it is possible to arrange a recorder in the object 14 so as to permit subsequent retrieval of information processed in the object 14, such as information received from a sonar antenna belonging to the object.

The invention claimed is:

1. A line intended to be submerged in an aquatic environment, comprising:

a mooring configured to be placed on a bottom of the aquatic environment and for immobilizing the line relative to the bottom, a buoy configured to float on a surface of the aquatic environment, an object extending along a vertical axis, having a center of balance of hydrodynamic forces when the object is subjected to a horizontal water current, being hydrodynamic center, and having a center of gravity vertically remote from the hydrodynamic center, a frame connected to the object by a pivoting link with a substantially horizontal axis passing through the hydrodynamic center, at least one fin extending vertically, whereby the object can be oriented relative to a horizontal water current, the at least one fin being secured to the frame, a first section of line connecting the mooring to the frame, a second section of line connecting the frame to the buoy.

2. The line as claimed in claim 1, wherein the object comprises an upper part that is configured to receive and/or transmit information to the aquatic environment and a lower part that comprises utilities, and in that the at least one fin faces the lower part without facing the upper part.

3. The line as claimed in claim 1, wherein the pivoting link comprises two bearings connecting the object to the frame, the two bearings being coaxial and arranged on either side of the hydrodynamic center.

4. The line as claimed in claim 1, further comprising a swivel arranged between the mooring and the frame.

5. The line as claimed in claim 4, wherein the swivel is arranged between the first section of line and the frame.

6. The line as claimed in claim 1, wherein the object comprises an acoustic transmitter.

7. The line as claimed in claim 1, wherein the object comprises an acoustic receiver.

8. The line as claimed in claim 7, wherein the second section of line comprises a cable that is configured to send information from the object to the buoy, and the buoy comprises a transmitter that is configured to send, through air outside of the aquatic environment, the information received from the object.

* * * * *